US010198930B2

(12) United States Patent
Melton et al.

(10) Patent No.: US 10,198,930 B2
(45) Date of Patent: Feb. 5, 2019

(54) SYSTEMS AND METHODS FOR IMPROVED MONITOR ATTACHMENT

(71) Applicant: BI Incorporated, Boulder, CO (US)

(72) Inventors: Donald A. Melton, Boulder, CO (US); Larry T. Cooper, Berthoud, CO (US); Rod E. Ward, Longmont, CO (US)

(73) Assignee: BI Incorporated, Boulder, CO (US)

( * ) Notice: Subject to any disclaimer, the term of this patent is extended or adjusted under 35 U.S.C. 154(b) by 0 days.

(21) Appl. No.: 15/075,982

(22) Filed: Mar. 21, 2016

(65) Prior Publication Data

US 2017/0270778 A1 Sep. 21, 2017

(51) Int. Cl.
*G08B 21/22* (2006.01)
*G08C 23/04* (2006.01)
*G08B 21/02* (2006.01)

(52) U.S. Cl.
CPC ..... *G08B 21/22* (2013.01); *G08B 21/0272* (2013.01); *G08B 21/0286* (2013.01); *G08C 23/04* (2013.01); *G08B 21/0288* (2013.01)

(58) Field of Classification Search
CPC ..... G08B 21/22; G08B 29/08; G08B 25/016; G08B 21/0286; G08B 21/0288; G08B 21/0269; G08B 21/0258; G08B 21/0261; G08B 21/00; G08B 21/02
See application file for complete search history.

(56) References Cited

U.S. PATENT DOCUMENTS 5,298,884 A 3/1994 Gilmore
7,930,927 B2 4/2011 Cooper et al.
8,493,219 B2 7/2013 Buck et al.
8,576,065 B2 11/2013 Buck et al.
8,629,776 B2 1/2014 Buck et al.
8,657,744 B2 2/2014 Rompa et al.
9,240,118 B2 1/2016 Melton
9,241,659 B2 1/2016 Rompa et al.
2007/0017136 A1* 1/2007 Mosher, Jr. ..... A61B 5/117 40/633
2008/0216561 A1* 9/2008 Cooper ..... A61B 5/0002 73/53.01
2011/0154887 A1 6/2011 Cooper et al.
2013/0006066 A1 1/2013 Melton
2015/0048948 A1 2/2015 Buck et al.
2015/0061864 A1 3/2015 Buck et al.
2015/0078622 A1 3/2015 Buck et al.
2015/0098077 A1* 4/2015 Findlay ..... G01K 11/32 356/73.1
2015/0131085 A1 5/2015 Cooper et al.
2015/0228184 A1 8/2015 Buck et al.
2015/0279200 A1 10/2015 Buck et al.
2015/0327214 A1 11/2015 Buck et al.

OTHER PUBLICATIONS

U.S. Appl. No. 13/919,862, filed Jun. 17, 2013, Newell et al.
U.S. Appl. No. 14/966,135, filed Dec. 11, 2015, Donald A. Melton
U.S. Appl. No. 15/066,959, filed Mar. 10, 2016, Keays.

* cited by examiner

*Primary Examiner* — Kabir A Timory

(74) *Attorney, Agent, or Firm* — Hamilton, DeSanctis & Cha

(57) ABSTRACT

The present invention is related to monitoring movement, and in particular to systems and methods for securing a monitoring device to a monitor target.

23 Claims, 7 Drawing Sheets

SYSTEMS AND METHODS FOR IMPROVED MONITOR ATTACHMENT

BACKGROUND OF THE INVENTION

The present invention is related to monitoring movement, and in particular to systems and methods for securing a monitoring device to a monitor target.

Large numbers of individuals are currently housed in prisons. This represents a significant cost to society both in terms of housing expense and wasted productivity. To address this concern, house arrest systems have been developed for use by less violent offenders. This allows the less violent offender to be monitored outside of a traditional prison system and allows the offender an opportunity to work and interact to at least some degree in society. The same approach is applied to paroled prisoners allowing for a monitored transition between a prison atmosphere and returning to society. House arrest systems typically require attaching a monitoring device to a monitored individual. Such devices may be defeated through tampering, and as such the ability to monitor the individuals may be defeated.

Thus, for at least the aforementioned reasons, there exists a need in the art for more advanced approaches, devices and systems for individual monitoring.

BRIEF SUMMARY OF THE INVENTION

The present invention is related to monitoring movement, and in particular to systems and methods for securing a monitoring device to a monitor target.

Various embodiments of the present invention provide monitoring systems. The monitoring systems include a strap, a male connector, and an interfering element. The strap includes an optical path separated by an opening. The male connector includes an optical bridge that when inserted in the opening provides an optical bridge connecting to the optical path. The interfering element is operable to block light transmitted along the optical path when the male connector is not inserted in the opening.

This summary provides only a general outline of some embodiments according to the present invention. Many other objects, features, advantages and other embodiments of the present invention will become more fully apparent from the following detailed description, the appended claims and the accompanying drawings and figures.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Figure 1A:
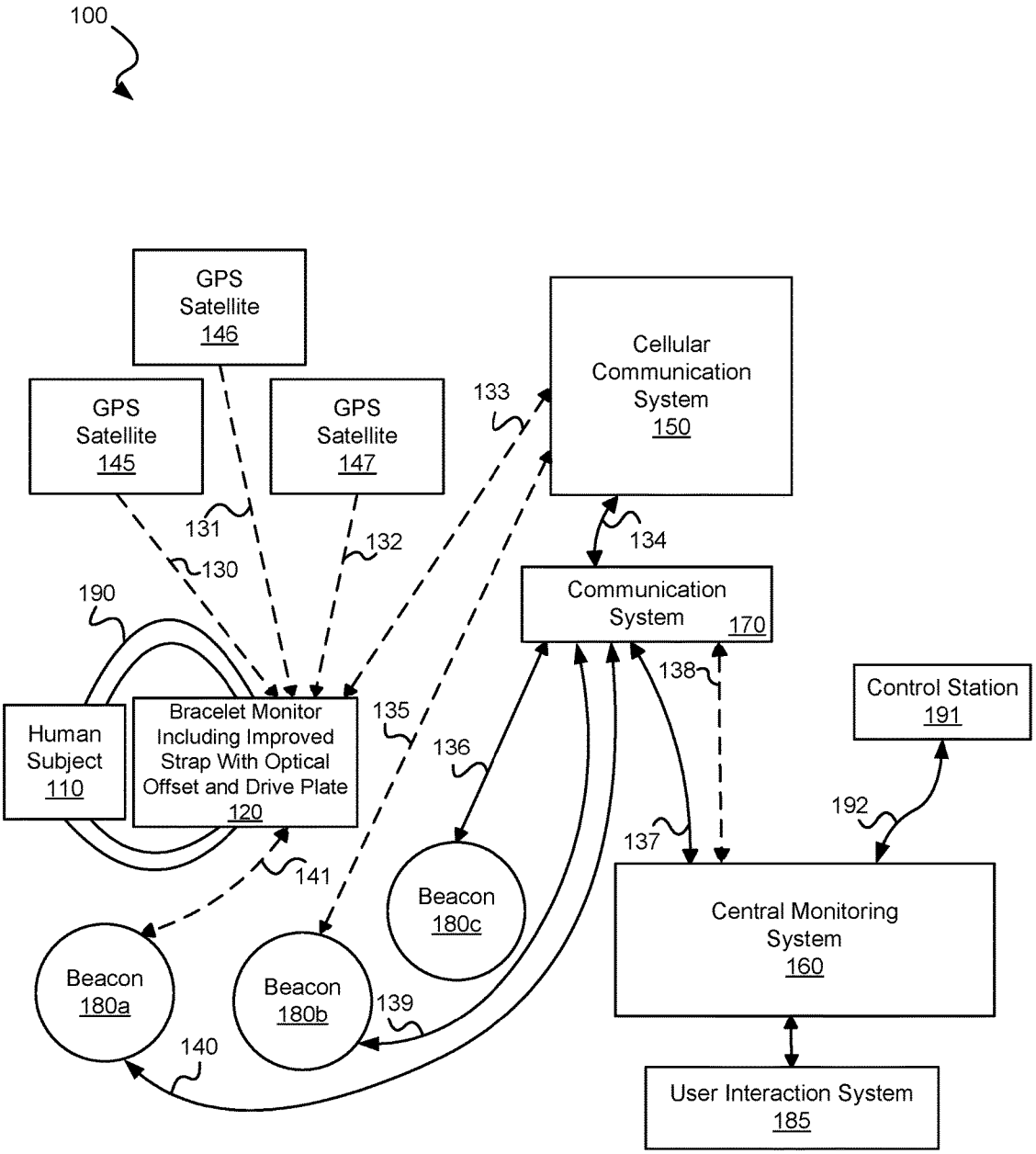
FIG. 1*a* is a block diagram illustrating a monitoring system including a subject device in the form of a bracelet monitor that includes an improved strap with optical offset and a drive plate in accordance with various embodiments of the present inventions.

The present invention is related to monitoring movement, and in particular to systems and methods for securing a monitoring device to a monitor target.

Some embodiments of the present inventions provide monitoring devices that include a tracker and a strap. The strap is operable to secure the tracker around the limb of a monitor target. The tracker includes proximity detection circuitry operable to indicate a tamper when one or both of the tracker and the strap are moved away from the limb. The strap includes: a fiber optic conductor extending from a first end of the strap to a second end of the strap, where the fiber optic conductor is offset from a centerline of the strap such that it aligns with optical couplers in both ends of the tracker; a conductive polymer extending along a surface of the strap; and a drive plate in the second end of the strap, where the drive plate is inserted into a cutout region surrounded on four sides by the conductive polymer.

In some instances of the aforementioned embodiments, the fiber optic conductor is offset from the centerline by a first distance at the first end of the strap, and is offset by a second distance at the second end of the strap. In some such instances, the first distance is the same as the second distance. In other instances, the first distance is different from the second distance.

In various instances of the aforementioned embodiments, the drive plate is capacitively coupled to the conductive polymer via a dielectric. In some instances of the aforementioned embodiments, the drive plate is physically connected to the conductive polymer. In some cases, the drive plate is metal. In one or more instances of the aforementioned embodiments, the drive plate is operable to transfer charge from a power source in the tracker to the conductive polymer. In some cases, the drive plate exhibits a surface area of greater than one inch square. In one particular case, the four sides of the drive plate are: a first side which is a flat surface with an area greater than one inch square; a second side which is a rectangular area extending along a first length of the first side and being less than one eighth inch in height; a third side which opposite the second side and is a rectangular area extending along the first length of the first side and being less than one eighth inch in height; and a fourth side which is a rectangular area extending along a second length of the first side and being less than one eighth inch in height.

Other embodiments of the present inventions provide straps that include a fiber optic conductor extending from a first end of the strap to a second end of the strap. The fiber optic conductor is offset from a centerline of the strap such that it aligns with optical couplers in both ends of a tracker device. In some instances of the aforementioned embodiments, the fiber optic conductor is offset from the centerline by a first distance at the first end of the strap, and is offset by a second distance at the second end of the strap. In some cases, the first distance is the same as the second distance. In other cases, the first distance is different from the second distance.

In various instances of the aforementioned embodiments, the strap further includes: a conductive polymer extending along a surface of the strap; and a drive plate in the second end of the strap, where the drive plate is inserted into a cutout region surrounded on four sides by the conductive polymer. In some cases, the drive plate is capacitively coupled to the conductive polymer via a dielectric. In one or more cases, the drive plate is physically connected to the conductive polymer.

Yet other embodiments of the present inventions provide straps that include: a conductive polymer extending along a surface of the strap; and a drive plate in the second end of the strap, where the drive plate is inserted into a cutout region surrounded on four sides by the conductive polymer. In some cases, the four sides are: a first side which is a flat surface with an area greater than one inch square; a second side which is a rectangular area extending along a first length of the first side and being less than one eighth inch in height; a third side which opposite the second side and is a rectangular area extending along the first length of the first side and being less than one eighth inch in height; and a fourth side which is a rectangular area extending along a second length of the first side and being less than one eighth inch in height. In one or more instances of the aforementioned embodiments, the drive plate is a metal plate operable to transfer charge from a power source in the tracker to the conductive polymer, and the drive plate exhibits a surface area of greater than one inch square.

Turning to FIG. 1*a*, a monitoring system 100 including a subject device in the form of a bracelet monitor that includes an improved strap with optical offset and a drive plate is shown in accordance with various embodiments of the present inventions. Monitoring system 100 may be tailored for tracking human subjects as is referred in this detailed description. However, it should be noted that various implementations and deployments of monitoring system 100 may be tailored for tracking other animals or even inanimate objects such as, for example, automobiles, boats, equipment, shipping containers or the like.

Monitoring system 100 includes a subject device that may be, but is not limited to, a bracelet monitor 120 that is physically coupled to a human subject 110 by a securing device 190. In some cases, securing device 190 is a strap that includes: an optical continuity sensor that is offset to assure proper attachment and to minimize the potential for manipulation, and a drive plate integrated with a conductive polymer which together form part of a capacitive proximity sensor. When bracelet monitor 120 is pulled away from the human subject, the proximity sensor is triggered generating a device tamper indication. When securing device 190 is severed, transmission via the optical continuity sensor is interrupted resulting in a device tamper indication. Based on the disclosure provided herein, one of ordinary skill in the art will recognize a variety of other tamper sensors that may be incorporated in either bracelet monitor 120 or securing device 190 to allow for detection of removal of bracelet monitor 120 or other improper or unexpected meddling with bracelet monitor 120.

Additionally, bracelet monitor 120 may be designed to provide the location of human subject 110 under a number of conditions. For example, when bracelet monitor 120 is capable of receiving wireless GPS location information 130, 131, 132 from a sufficient number of GPS satellites 145, 146, 147, respectively, bracelet monitor 120 may use the received wireless GPS location information to calculate or otherwise determine the location of human subject 110. Alternatively or in addition, the location of a tethered beacon 180 that is local to bracelet monitor 120 may be used as the location of bracelet monitor 120. As yet another alternative, an AFLT fix may be established based on cellular communication with bracelet monitor 120. It should be noted that other types of earth based triangulation may be used in accordance with different embodiments of the present invention. For example, other cell phone based triangulation, UHF band triangulation such as Rosum, Wimax frequency based triangulation, S-5 based triangulation based on spread spectrum 900 MHz frequency signals. Based on the disclosure provided herein, one of ordinary skill in the art will recognize other types of earth based triangulation that may be used.

As yet another alternative, an AFLT fix may be established based on cellular communications between bracelet monitor 120 and a cellular communication system 150. Furthermore, when wireless communication link 133 between bracelet monitor 120 and cellular communications system 150 is periodically established, at those times, bracelet monitor 120 may report status and other stored records including location fixes to a central monitoring system 160 via wireless communication link 138.

Monitoring system 100 may include one or more tethered beacons 180. Within FIG. 1*a*, a telemetric wireless link 141 has been depicted between tethered beacon 180*a* and bracelet monitor 120. Each tethered beacon 180 has an adjustable range to make telemetric wireless contact with bracelet monitor 120. At any point in time, depending on each beacon's 180 relative distance to bracelet monitor 120, none, one, or more than one tracking beacons 180 may be within transmission range of a single bracelet monitor 120 Likewise, it is further conceivable under various circumstances that more than one bracelet monitor 120 at times be within in range of a solitary tethered beacon 180.

Telemetric wireless communications path 141 established at times between tethered beacon 180*a* and bracelet monitor 120 illustrates a common feature of various different embodiments of the current invention. Some embodiments of the current invention vary on how, i.e. protocol, and what information and/or signaling is passed over wireless link 141. For example, in more simplified configurations and embodiments, each tethered beacon 180 is limited to repetitively transmitting its own beacon ID and motion sensor information. In that way, once bracelet monitor 120 is within transmission range of tethered beacon 180*a* and establishes wireless or wired reception 141, then bracelet monitor 120 can record and store received beacon ID. In particular cases where tethered beacon 180 is programmed with its physical location in addition to its beacon ID, the physical location information may also be repetitively transmitted. At a later time, for some embodiments of the present invention, bracelet monitor 120 can then report recorded readings from beacons 180 to the central monitoring system 160 over the cellular communication system 150 using wireless links 133 and 138 as depicted in FIG. 1*a*. Furthermore, many embodiments allow for such transmissions and information passing to occur without being noticed by human subject 110, and unnoticed, automatically, and near effortlessly central monitoring system 160 is able to establish records and track human subject's 110 movements and whereabouts.

Of note, a particular tethered beacon 180 includes a beacon ID which may be, but is not limited to, a beacon identification number. This beacon identification number is transmitted to a bracelet monitor in proximity of the particular tethered beacon. This identification number may be associated with a known location of the tethered beacon. As monitoring system 100 relies on the location associated with the beacon ID provided from the tethered beacon 180 to establish the location of bracelet monitor 120, moving the particular tethered beacon away from the known location undermines the integrity of information provided from bracelet monitor 120 to central monitoring system 160. To avoid this, each of tethered beacons 180 are tethered to a fixed location power source that controls a level of motion sensing provided by the tethered beacon. Tethering beacons 180 to a power source may be done, for example, by connecting the tethered beacon to an AC wall outlet, connecting the tethered beacon to a telephone jack, connecting the tethered beacon to a cable jack, or the like. Based upon the disclosure provided herein, one of ordinary skill in the art will recognize a variety of non-movable power sources to which tethered beacons 180 may be connected in accordance with different embodiments of the present invention.

Tethered beacons 180 each include a multi-level motion sensing circuit that is operable to determine whether a respective tethered beacon 180 is moving. When a particular tethered beacon 180 is connected to a power source, a low sensitivity motion sensor circuit is employed to determine motion. In contrast, when the particular tethered beacon 180 is not connected to a power source, a high sensitivity motion sensor circuit is employed to determine motion. Thus, when tethered beacon 180 is connected to a power source and is less likely to be the subject of problematic motion (i.e., motion that impacts the integrity of location data transferred from bracelet monitor 120 to central monitoring system 160), the motion sensing employed is less sensitive. As such, the possibility of a false positive (e.g., indicating motion of the tethered beacon caused by loud music playing near the tethered beacon) when the tethered beacon 180 is unlikely to be moving is reduced. In contrast, the possibility of problematic motion is increased when tethered beacon 180 is disconnected from the power source, and in such a scenario the motion detection sensitivity is increased. In some cases, tethered beacons 180 include GPS and/or cellular communication based location circuitry that is turned on when motion is detected to obtain an updated location.

In other embodiments or configurations according to the present invention, each tethered beacon 180 also transmit status information related to its own device health and information related from each beacon's 180 internal tampering, movement, or other sensors via a communication system 170 to central monitoring system 160. This allows for detection of movement of beacons 180, and establishing some level of confidence that the physical location associated with each of beacons 180 is accurate.

Likewise, in some other embodiments, each bracelet monitor 120 contains a host of their own tampering, shielding, movement, and/or other sensors related to its own device health. While still further embodiments also include a host of other measurement transducers within bracelet monitor 120 for extracting information, and for later reporting, related to physical properties of human subject 110. For example, measuring for the presence of alcohol and/or other drugs present in human subject 110 may be included in some embodiments of bracelet monitor 120. As one example, the alcohol sensor discussed in U.S. Pat. No. 7,930,927 entitled "Transdermal Portable Alcohol Monitor and Methods for Using Such" and filed by Cooper et al. on Mar. 4, 2008. The entirety of the aforementioned reference is incorporated herein by reference for all purposes.

Tethered beacons 180 in alternative embodiments of the present invention also communicate with central monitoring system 160 independently of bracelet monitor 120. The monitoring system 100 illustrated in FIG. 1*a* shows tethered beacon 180*b* having both a wireless communication link 135 with cellular communication system 150, and also illustrates tethered beacon 180*b* having a hardwired communication link 139 with communication system 170. Monitoring system 100 is also shown with tethered beacons 180*a*, 180*b*, and 180*c* each having hardwired land communication links 140, 139, and 136 respectively to land communication system 170. Monitoring system 100 further illustrates land communication system 170 having a hardwired communication link 134 to cellular communication system 150, and a hardwired communication link 137 to central monitoring system 160.

In some embodiments of the present invention, tethered beacons 180 are located in areas frequented by human subject 110 where bracelet monitor 120 is incapable of accessing information from the GPS system, or simply where power used accessing information from a GPS or cellular location system can be saved. Such beacons eliminate the need to perform an AFLT fix and avoid the costs associated therewith. As an example, human subject 110 may have a tethered beacon 180 placed within his home, and one also placed at his place of employment in close proximity to his work area. In this way, the two placed beacons, each at different prescribed times, can interact with his attached bracelet monitor 120 to periodically make reports to central monitoring system 160 to track movements and the whereabouts of human subject 110. All this can be done without incurring the costs associated with performing an AFLT fix. Central monitoring station 160 may be controlled via a control station 191 wired via a link 192. A user interaction system 185 allows for sharing data from central monitoring station to one or more third parties. Such third parties may be, for example, law enforcement personnel, parole officers, employers, or the like. In some cases, user interaction system 185 is an Internet website. Based upon the disclosure provided herein, one of ordinary skill in the art will recognize other approaches that may be used for allowing user interaction with monitoring system 100.

Figure 1B:
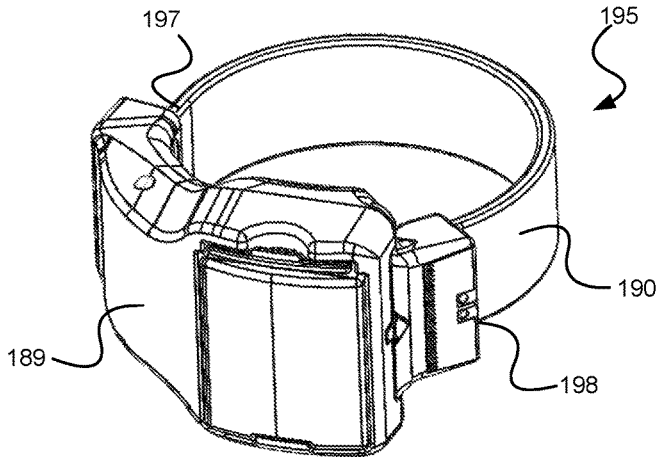
FIG. 1*b* depicts a bracelet monitor having a tracker and a strap in a connected position extending from one side of the tracker to the other side in accordance with some embodiments of the present inventions.
Figure 1C:
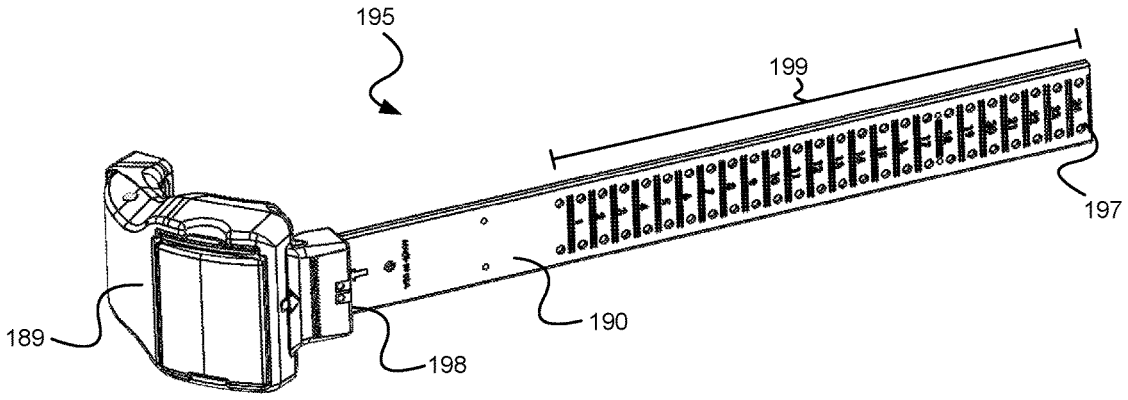
FIG. 1*c* depicts the bracelet monitor of FIG. 1*b* with the strap disconnected from a first end of the tracker and connected at a second end of the tracker in accordance with some embodiments of the present inventions.

Turning to FIG. 1*b*, a bracelet monitor 195 having a tracker 189 connected at a opposite ends to a first end 197 and a second end 198 of strap 190 is shown in accordance with some embodiments of the present inventions. Turning to FIG. 1*c*, bracelet monitor 195 is shown with first end 197 disconnected from tracker 189. A length 199 of strap 190 includes a number of connection points where strap 190 can be cut for fitting around a limb of a target. The connection points each include two holes through strap 190 where each of the two holes is equa-distant from second end 198. When installed in relation to a target, strap 190 is cut to a length allowing it to fit snugly around the limb of the target. The strap is then placed around the limb of the target with first end 197 being placed into a strap receiver (not shown) at the edge of tracker 189. Finally, two pins are placed through both the strap receiver and the two holes at the far end of first end 197 of strap 190, and the two pins are secured in place. At this juncture, the only way to remove bracelet monitor 195 is to: (1) cut strap 190, (2) stretch strap 190 until it can be slipped off the limb, (3) break the mechanical device that secures the two pins and thereby disconnect strap 190 from first end 197, and/or (4) break the mechanical device that secures second end 198 of strap 190 to tracker 189. Tracker 189 includes sensors capable of detecting any of the aforementioned disconnect mechanisms. When a disconnect is sensed, tracker 189 sends a device tamper indication to central monitoring system 160.

Figure 1D:
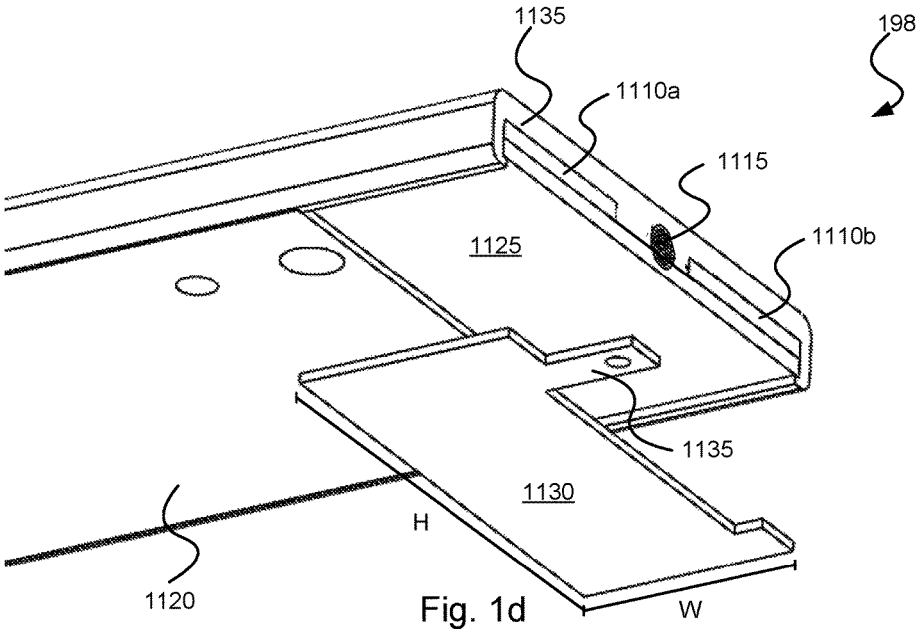
FIG. 1*d* depicts a second end of the strap of FIG. 1*c* that is connected to the second end of the tracker and includes a drive plate in accordance with some embodiments of the present inventions.

Turning to FIG. 1*d*, a detailed view of second end 198 of strap 190 is shown. Second end 198 includes a bottom surface region 1120 formed of an electrically conductive polymer. In some particular embodiments, the electrically conductive polymer includes carbon fiber and/or carbon powder incorporated into an otherwise non-conductive polymer. Second end 198 includes a cutout region 1125 where a portion of bottom surface region 1120 has been either removed or bottom surface region 1120 was molded to include cutout region 1125. Cutout region 1125 is approximately the same width (W) and height (H) as a drive plate 1130. Drive plate 1130 is a metal plate which is insertable into cutout region 1125 or where a cutout region is not used attachable to the surface of strap 190. In some embodiments, drive plate 1130 is made of a non-precious metal (i.e., not made of Gold, Platinum, or Sliver). Use of such a non-precious metal reduces the cost of drive plate when compared with button or contact point based approaches where a precious metal is used to assure sufficient contact. Drive plate 1130 includes a connection point 1135 that extends into the end of tracker 189 associated with second end 198. When installed in tracker 189, connection point 1135 makes an electrical connection to a proximity sensor circuit (not shown) within tracker 189 which is designed to detect if tracker 189 and/or strap 190 have been moved too far from a limb around which bracelet monitor 120 is installed. Drive plate 1130 offers a large contact surface area with bottom surface region 1120 at cutout region 1125 when compared with prior connection capability which offered smaller area, less stable connectivity. By incorporating drive plate 1130 into strap 190, the stability and integrity of the proximity detection circuitry included in tracker 189 is enhanced. As one example, the proximity sensor circuit discussed in US Pat. No. 5,298,884 may be implemented in accordance with different embodiments of the present inventions. The entirety of the aforementioned reference entitled "Tamper Detection Circuit and Method for Use with Wearable Transmitter Tag" and filed Oct. 16, 1992 is incorporated herein by reference for all purposes. Where such an approach is used, it is modified to include the novel drive plate and cutout region discussed herein. Based upon the disclosure provided herein, one of ordinary skill in the art will recognize other proximity sensing circuits that may be enhanced by the novel drive plate and cutout region discussed herein. Drive plate 1130 is either connected by contact with strap 190 or capacitively connected with strap 190 by a small gap. In some embodiments, where drive plate 1130 is capacitively coupled to strap 190, the capacitance exhibited at the interface between drive plate 1130 and strap 190 should be greater than ten times the capacitance expected in the proximity sensor circuit to avoid false tampers indicated by the proximity sensor circuit.

Strap 190 also includes a fiber optic conductor 1115 extending from first end 197 to second end 198. Fiber optic conductor 1115 is optically connected to a fiber optic couplers (not shown) on both ends of tracker 189. When installed, fiber optic conductor 1115 transmits a light signal from one end of tracker 189 through strap 190 to the other end of tracker 189. When the light signal is interrupted, tracker 189 issues a tamper indication indicating that that strap 190 has possibly been cut or has experienced some level of tampering or degradation. In addition, strap 190 includes two stiffener bands 1110*a*, 1110*b* extending the length of strap 190, and a surrounding top surface polymer which extends over the edges of strap 190. Stiffener bands 1110*a*, 1110*b* are made of a polymer material that exhibits a strength greater than that of electrically conductive polymer 1120 and/or a surface polymer 1135 and are used to increase tensil strength.

Figure 1E:
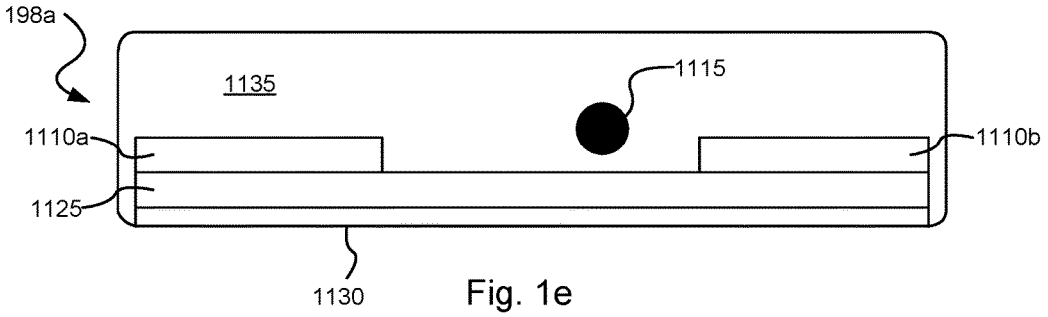
FIG. 1*e* depicts a cross section of the second end of the strap of FIG. 1*c* where the drive plate is physically touching a conductive polymer in accordance with some embodiments of the present inventions.

Turning to FIG. 1*e*, a cross section of second end 198 of strap 190 is shown in accordance with some embodiments of the present inventions. In this embodiment, drive plate 1130 is physically touching bottom surface region 1120 at cutout region 1125. Such a connection between the metal of drive plate 1130 and the electrically conductive polymer of bottom surface region 1120 allows for an electrical charge emanating from the proximity sensor circuit of tracker 189 to be transferred to bottom surface region 1120 via drive plate 1130. This electrical charge forms the operational basis of the proximity sensor circuit of tracker 189.

Figure 1F:
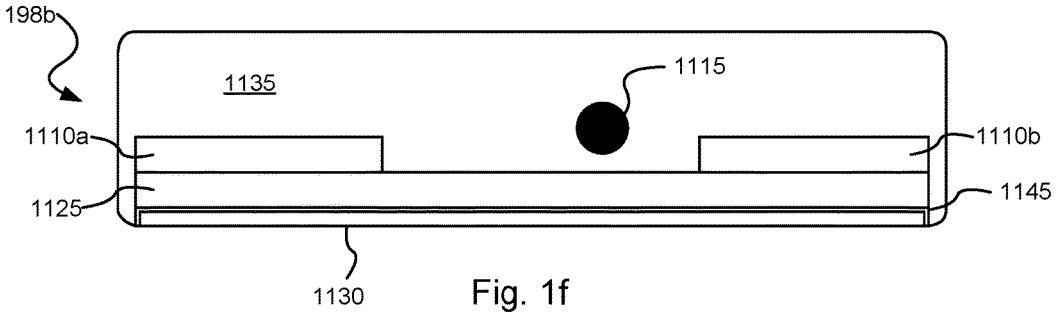
FIG. 1*f* depicts a cross section of the second end of the strap of FIG. 1*c* where the drive plate is separated from a conductive polymer by a dielectric in accordance with one or more embodiments of the present inventions.

Turning to FIG. 1*f*, another cross section of second end 198 of strap 190 is shown in accordance with other embodiments of the present inventions. In this embodiment, drive plate 1130 is separated from bottom surface region 1120 at cutout region 1125 by a dielectric 1145. Dielectric 1145 may be, for example, air. This results in a capacitive coupling between the metal of drive plate 1130 and the electrically conductive polymer of bottom surface region 1120. This capacitive coupling causes a current to flow through electrically conductive polymer. A charge build up on bottom surface region 1120 forms the operational basis of the proximity sensor circuit of tracker 189.

Figure 1G:
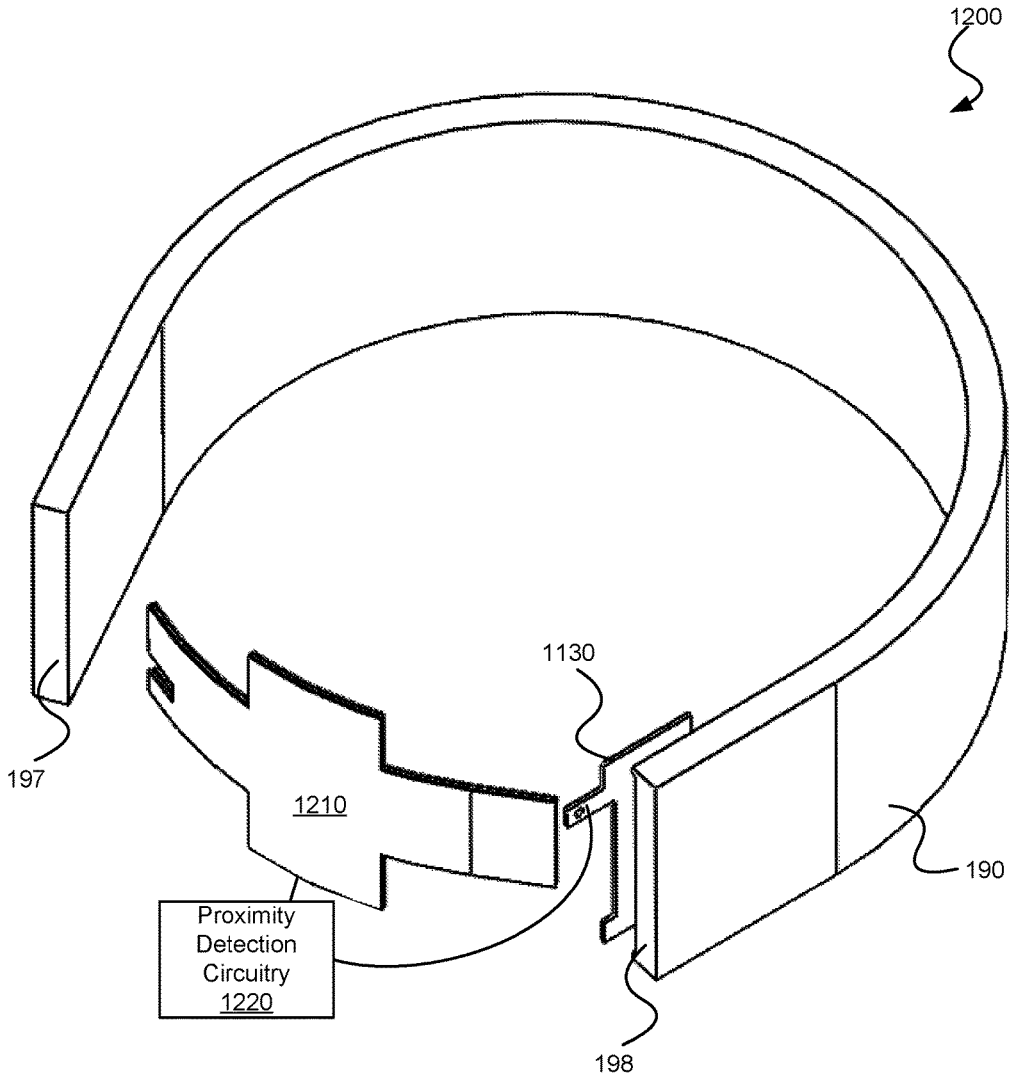
FIG. 1*g* shows the strap of FIG. 1*c* in relation to a capacitor plate internal to the tracker where the capacitor plate is connected to proximity detection circuitry in accordance with various embodiments of the present inventions.

Turning to FIG. 1*g*, a cut away view 1200 shows strap 190 in relation to a capacitor plate 1210 internal to tracker 189 where capacitor plate 1210 is connected to proximity detection circuitry 1220 in accordance with various embodiments of the present inventions. As shown, proximity detection circuitry 1220 is electrically connected to drive plate 1130 when second end 198 of strap 190 is installed in tracker 189. In such a configuration, proximity detection circuitry 1220 applies a voltage to drive plate 1130 causing a charge build up on the inner surface of strap 190. This charge build up is capacitively coupled to capacitor plate 1210, and the charge induced on capacitor plate 1210 is sensed by proximity detection circuitry 1220. Again, proximity detection circuitry 1220 may be implemented similar to that discussed in U.S. Pat. No. 5,298,884 which was previously incorporated herein by reference for all purposes. Based upon the disclosure provided herein, one of ordinary skill in the art will recognize other proximity sensing circuits that may be enhanced by the novel drive plate and cutout region discussed herein.

Figure 1H:
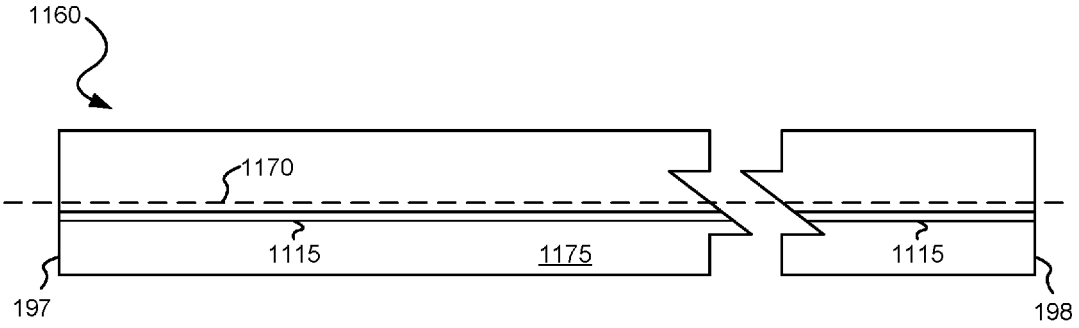
FIG. 1*h* depicts a top view of the strap of FIG. 1*c* showing a fiber optic conductor extending from a first end of the strap to a second end of the strap where the fiber optic conductor is offset from a centerline of the strap in accordance with some embodiments of the present inventions.
Figure 1I:
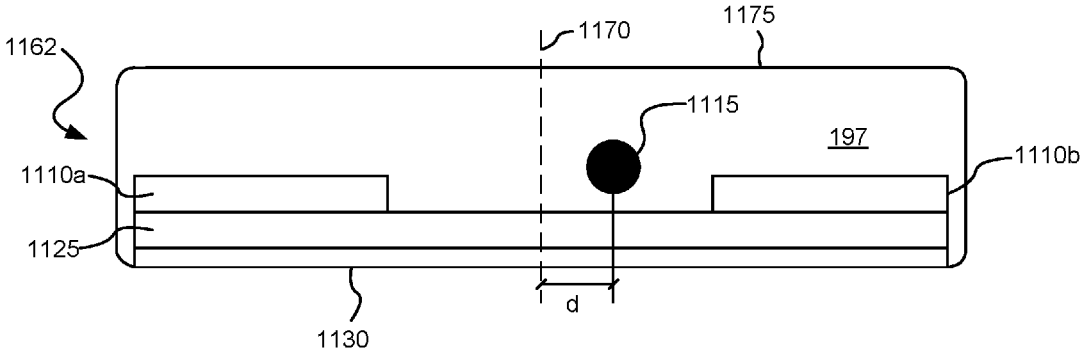
FIG. 1*i* depicts a cross section of the first end of the strap of FIG. 1*h* showing the fiber optic conductor offset from the centerline of the strap in accordance with some embodiments of the present inventions.
Figure 1J:
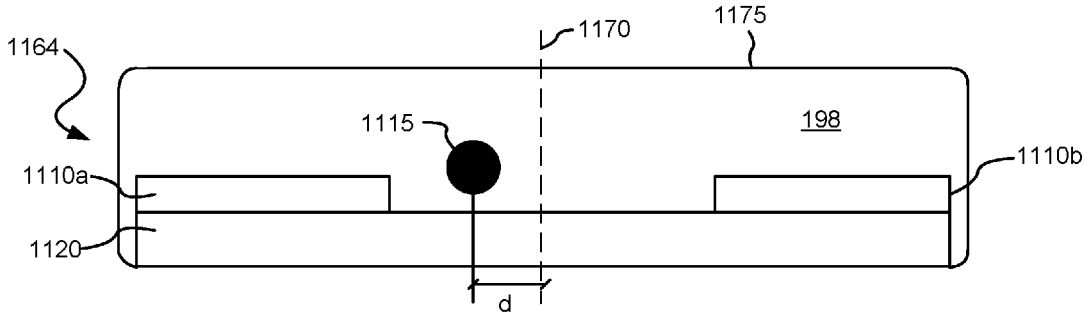
FIG. 1*j* depicts a cross section of the second end of the strap of FIG. 1*h* showing the fiber optic conductor offset from the centerline of the strap in accordance with some embodiments of the present inventions.

Turning to FIG. 1*h*, a top view 1160 of strap 190 shows a top surface 1175 of strap 190 and fiber optic conductor 1115 extending from first end 197 of strap 190 to second end 198 of strap 190. Turning to FIG. 1*i*, a cross sectional view 1162 of first end 197 of strap 190 is shown with fiber optic conductor 1115 offset from centerline 1170 of strap 190 by a distance d. Turning to FIG. 1*j*, a cross sectional view 1164 of second end 198 of strap 190 is shown with fiber optic conductor 1115 offset from centerline 1170 of strap 190 by the same distance d exhibited in first end 197.

Of note, fiber optic conductor 1115 is offset from a centerline 1170 of strap 190 in accordance with some embodiments of the present inventions. By offsetting fiber optic conductor 1115 from centerline 1170, with top surface 1175 oriented away from the limb around which strap 190 is being placed strap 190 can only be installed in one orientation relative to tracker 189. In particular, where second end 198 which includes drive plate 1130 is installed in an end of tracker 189 that is not designed to couple to drive plate 1130 fiber optic conductor 1115 will not align with a fiber optic coupler (not shown) included within tracker 189. Where such a misalignment occurs, a tamper detection indicating a break in fiber optic conductor will remain asserted leaving a clear indication that strap 190 is not installed correctly. Alternatively, where second end 198 which includes drive plate 1130 is installed in an end of tracker 189 that is designed to couple to drive plate 1130 fiber optic conductor 1115 will align with a fiber optic coupler (not shown) included within tracker 189. Where such an alignment is achieved, a tamper detection indicating a break in fiber optic conductor will not remain asserted leaving a clear indication that strap 190 is installed correctly.

Figure 1K:
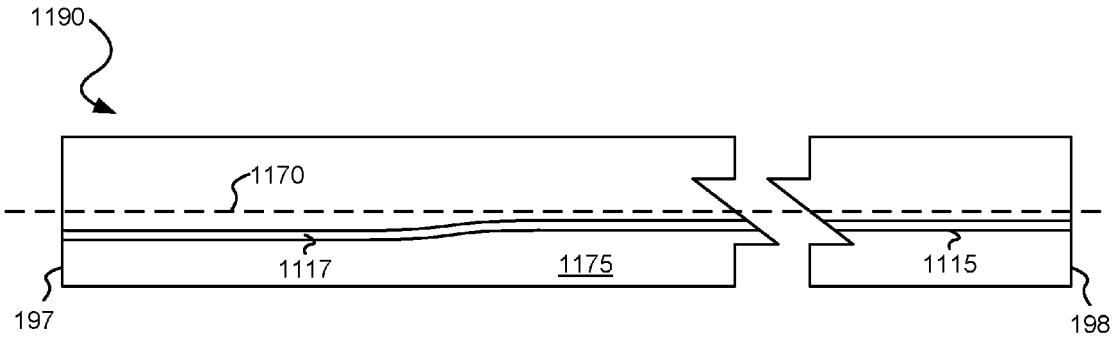
FIG. 1*k* depicts a top view of the strap of FIG. 1*c* showing a fiber optic conductor extending from a first end of the strap to a second end of the strap where the fiber optic conductor is variably offset from a centerline of the strap in accordance with other embodiments of the present inventions.
Figure 1L:
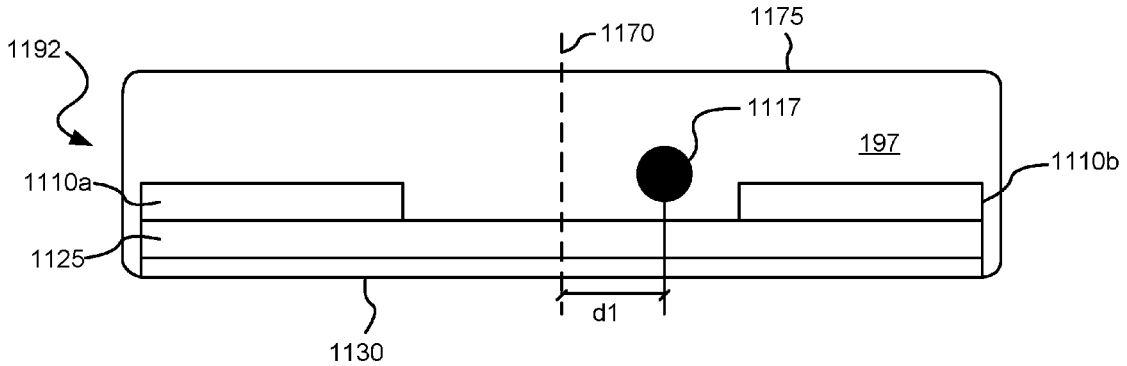
FIG. 1*l* depicts a cross section of the first end of the strap of FIG. 1*k* showing the fiber optic conductor offset from the centerline of the strap by a first distance in accordance with other embodiments of the present inventions.
Figure 1M:
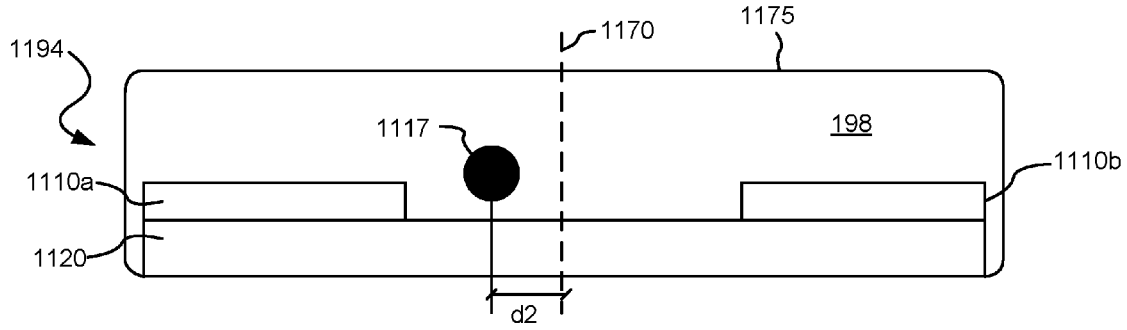
FIG. 1*m* depicts a cross section of the second end of the strap of FIG. 1*k* showing the fiber optic conductor variably offset from the centerline of the strap by a second distance in accordance with other embodiments of the present inventions.

Turning to FIG. 1*k*, an alternative embodiment of strap 190 where a top view 1190 of strap 190 shows a top surface 1175 of strap 190 and a varied offset fiber optic conductor 1117 extending from first end 197 of strap 190 to second end 198 of strap 190. Varied offset fiber optic conductor 1117 is offset from centerline 1170 by a first distance (d1) at first end 197 and by a second distance (d2) at second end 198. Turning to FIG. 11, a cross sectional view 1192 of first end 197 of strap 190 is shown with varied distance fiber optic conductor 1117 offset from centerline 1170 of strap 190 by the first distance (d1). Turning to FIG. 1*m*, a cross sectional view 1194 of second end 197 of strap 190 is shown with varied distance fiber optic conductor 1117 offset from centerline 1170 of strap 190 by the second distance (d2). As shown, the first distance is greater than the second distance.

Of note, fiber optic conductor 1117 is offset by a different distance from a centerline 1170 of strap 190 at each of first end 197 and second end 198. By variably offsetting fiber optic conductor 1117 from centerline 1170 in such a way, strap 190 can only be installed in tracker 189 in one way and is not dependent upon top surface 175 being away from the limb around which strap 190 is being placed. In particular, where second end 198 which includes drive plate 1130 is installed in an end of tracker 189 that is not designed to couple to drive plate 1130 fiber optic conductor 1117 will not align with a fiber optic coupler (not shown) included within tracker 189. Where such a misalignment occurs, a tamper detection indicating a break in fiber optic conductor will remain asserted leaving a clear indication that strap 190 is not installed correctly. Alternatively, where second end 198 which includes drive plate 1130 is installed in an end of tracker 189 that is designed to couple to drive plate 1130 fiber optic conductor 1117 will align with a fiber optic coupler (not shown) included within tracker 189. Where such an alignment is achieved, a tamper detection indicating a break in fiber optic conductor will not remain asserted leaving a clear indication that strap 190 is installed correctly.

Figure 2:
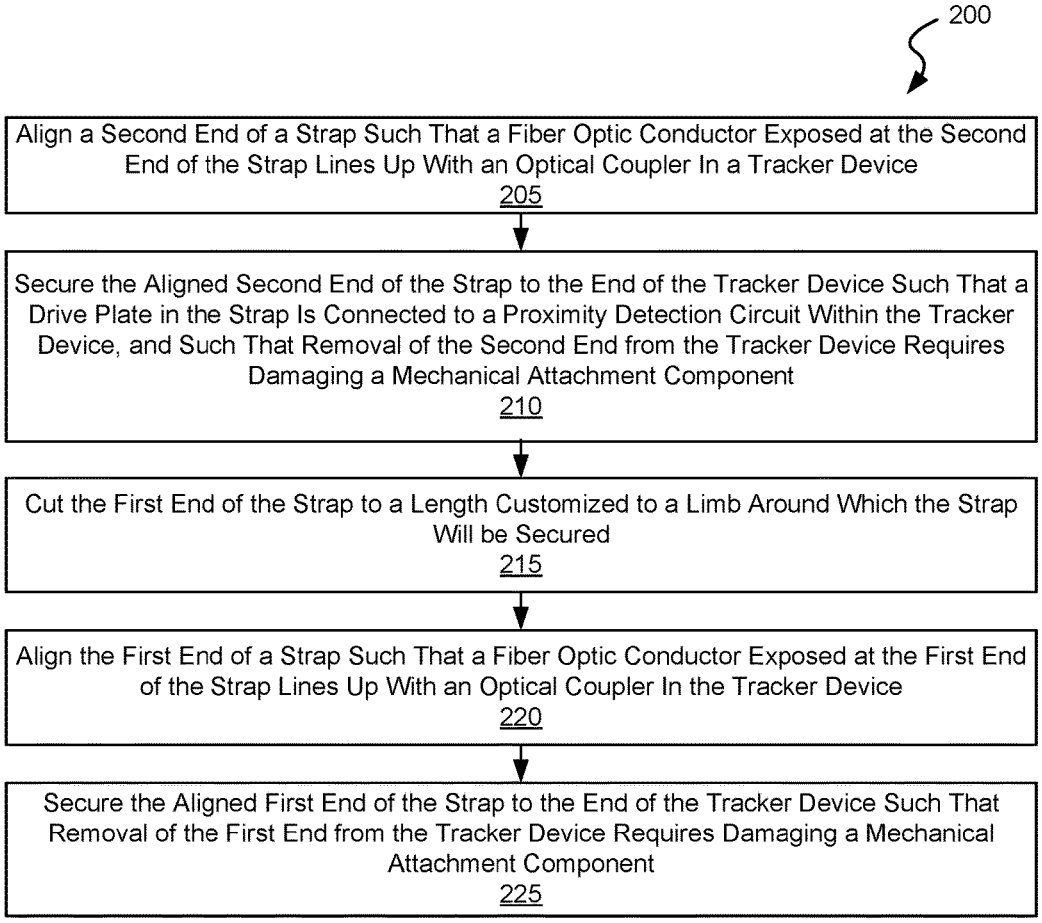
FIG. 2 is a flow diagram showing a method in accordance with some embodiments of the present inventions for using an improved strap with a drive plate and offset fiber optic conductor.

Turning to FIG. 2,a flow diagram 200 shows a method in accordance with some embodiments of the present inventions for using an improved strap with a drive plate and offset fiber optic conductor. Following flow diagram 200, a second end of a strap is aligned such that a fiber optic conductor exposed at the second end lines up with an optical coupler in a tracker device (block 205). The aligned second end is secured to the tracker device (block 210). The second end is secured such that a drive plate attached to the strap is electrically connected via a direct or capacitive coupling to a proximity detection circuit within the tracker. Such an electrical connection may be to a power and/or a signal source through which a charge is applied to a conductive surface of the strap via the drive plate. In addition, the securing process is done in such a way that removal of the second end of the strap from the tracker cannot be done without damaging a mechanical attachment component used either to secure the strap or to reduce access to the securing component.

A first end of the strap is cut to a length customized to the size of the limb around which the strap will be installed (block 215). In some cases, the cut locations are marked on the strap and include two holes through which securing components may be placed. The cut end is then aligned such that the fiber optic conductor exposed at the first end of the strap lines up with an optical coupler in the tracker device (block 220). The aligned first end is secured to the tracker device (block 225) such that the strap is around the limb and holds the tracker securely to the target. The first end is secured such that removal of the second end of the strap from the tracker cannot be done without damaging a mechanical attachment component used either to secure the strap or to reduce access to the securing component.

In conclusion, the present invention provides for novel systems, devices, and methods for monitoring individuals and/or assets. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A strap, the strap comprising:

a strap length, a strap height, a strap width, and a centerline, wherein the strap length is greater than the strap height and the strap height is greater than the strap width, and wherein the centerline is extends along the length of the strap equidistant from one side of the strap height and an opposite side of the strap height;

a fiber optic conductor extending along a length of the strap from a first end of the strap to a second end of the strap, wherein a center of the fiber optic conductor is located a non-zero offset from a centerline of the strap such that it aligns with optical couplers in both ends of a tracker device; and a drive plate in the second end of the strap, wherein the drive plate is inserted into a cutout region surrounded on four sides by a conductive polymer, wherein the four sides are:

a first side which is a flat surface with an area greater than one inch square;

a second side which is a rectangular area extending along a first length of the first side and being less than one eighth inch in height;

a third side which opposite the second side and is a rectangular area extending along the first length of the first side and being less than one eighth inch in height; and a fourth side which is a rectangular area extending along a second length of the first side and being less than one eighth inch in height.

2. The strap of claim 1, wherein the conductive polymer extends along a surface of the strap.

3. The strap of claim 2, wherein the drive plate is capacitively coupled to the conductive polymer via a dielectric.

4. The strap of claim 2, wherein the drive plate is physically connected to the conductive polymer.

5. The strap of claim 2, wherein the fiber optic conductor is offset from the centerline by a first distance at the first end of the strap, and is offset by a second distance at the second end of the strap.

6. The strap of claim 5, wherein the first distance is different from the second distance.

7. The strap of claim 5, wherein the first distance is the same as the second distance.

8. The strap of claim 1, wherein the conductive polymer is an electrically conductive polymer.

9. A strap, the strap comprising:

an electrically conductive polymer extending along a surface of the strap; and a drive plate in a first end of the strap, wherein the drive plate is inserted into a cutout region in the strap and surrounded on four sides by the electrically conductive polymer, wherein the four sides are:

a first side which is a flat surface with an area greater than one inch square;

a second side which is a rectangular area extending along a first length of the first side and being less than one eighth inch in height;

a third side which opposite the second side and is a rectangular area extending along the first length of the first side and being less than one eighth inch in height; and a fourth side which is a rectangular area extending along a second length of the first side and being less than one eighth inch in height; and wherein the first end of the strap is connectable to a first end of a device, and wherein a second end of the strap is connectable to a second end of a device.

10. The strap of claim 9, wherein the drive plate is a metal plate operable to transfer charge from a power source in the tracker to the electrically conductive polymer, and wherein the drive plate exhibits a surface area of greater than one inch square.

11. The strap of claim 9, the strap further comprising:

a strap length, a strap height, a strap width, and a centerline, wherein the strap length is greater than the strap height and the strap height is greater than the strap width, and wherein the centerline is extends along the length of the strap equidistant from one side of the strap height and an opposite side of the strap height; and a fiber optic conductor extending along a length of the strap from a first end of the strap to a second end of the strap, wherein a center of the fiber optic conductor is located a non-zero offset from a centerline of the strap such that it aligns with optical couplers in both ends of a tracker device.

12. A monitoring device, the monitoring device comprising:

a tracker and a strap, wherein the strap is operable to secure the tracker around a limb of a monitor target;

wherein the strap includes:

a fiber optic conductor extending from a first end of the strap to a second end of the strap, wherein the fiber optic conductor is offset a non-zero distance from a centerline of a length of the strap extending from the first end of the strap to the second end of the strap such that the fiber optic conductor aligns with a first optical coupler in the tracker at a location to which the first end of the strap attaches to the tracker and with a second optical coupler in the tracker at a location to which the second end of the strap attaches to the tracker;

a conductive polymer extending along a surface of the strap; and a drive plate in the second end of the strap, wherein the drive plate is inserted into a cutout region in the conductive polymer; and wherein the tracker includes a proximity detection circuit electrically coupled to the drive plate and operable to:

determine a movement of the monitoring device away from the limb, and indicate a tamper when at least one of the tracker and the strap are moved away from the limb.

13. The monitoring device of claim 12, wherein the drive plate is capacitively coupled to the conductive polymer via a dielectric.

14. The monitoring device of claim 12, wherein the drive plate is physically connected to the conductive polymer.

15. The monitoring device of claim 12, wherein the drive plate is metal.

16. The monitoring device of claim 12, wherein the drive plate is operable to transfer charge from a power source in the tracker to the conductive polymer.

17. The monitoring device of claim 12, wherein the drive plate exhibits a surface area of greater than one-quarter inch square.

18. The monitoring device of claim 12, wherein the conductive polymer is an electrically conductive polymer.

19. The monitoring device of claim 12, wherein the length of the strap extending from the first end of the strap to the second end of the strap is a strap length, and wherein the strap further includes:

a strap height and a strap width, wherein the strap length is greater than the strap height and the strap height is greater than the strap width; and wherein the centerline extends along the strap length equidistant from one side of the strap height and an opposite side of the strap height.

20. The monitoring device of claim 19, wherein the non-zero distance is a first distance, wherein the fiber optic conductor is offset from the centerline by the first distance at the first end of the strap, wherein the fiber optic conductor is offset from the centerline by a second distance at the second end of the strap, and wherein the first distance is less than the second distance.

21. The monitoring device of claim 20, wherein the first distance is the same as the second distance.

22. The monitoring device of claim 20, wherein the first distance is different from the second distance.

23. The monitoring device of claim 12, wherein the drive plate is surrounded by the conductive polymer on four sides, and wherein the four sides are:

a first side which is a flat surface with an area greater than one-quarter inch square;

a second side which is a rectangular area extending along a first length of the first side and being less than one eighth inch in height;

a third side which opposite the second side and is a rectangular area extending along the first length of the first side and being less than one eighth inch in height; and a fourth side which is a rectangular area extending along a second length of the first side and being less than one eighth inch in height.

* * * * *